US005481065A

United States Patent [19]

Yamada

[11] Patent Number: 5,481,065

[45] Date of Patent: Jan. 2, 1996

[54] ELECTRONIC MUSICAL INSTRUMENT HAVING PRE-ASSIGNED MICROPROGRAM CONTROLLED SOUND PRODUCTION CHANNELS

[75] Inventor: Hideo Yamada, Hamamatsu, Japan

[73] Assignee: Yamaha Corporation, Japan

[21] Appl. No.: 422,602

[22] Filed: Apr. 10, 1995

Related U.S. Application Data

[63] Continuation of Ser. No. 954,268, Sep. 30, 1992, abandoned.

[30] Foreign Application Priority Data

Oct. 7, 1991 [JP] Japan ..... 3-259452

[51] Int. Cl.[6] ..... G10H 1/18; G10H 7/00

[52] U.S. Cl. ..... 84/615; 84/622

[58] Field of Search ..... 84/600, 607, 615, 84/622, 653

[56] References Cited

U.S. PATENT DOCUMENTS

| | | | |
|---|---|---|---|
| 4,387,617 | 6/1983 | Kato et al. . | |
| 4,554,857 | 11/1985 | Nishimoto | 84/624 |
| 4,862,784 | 9/1989 | Kimpara . | |
| 5,040,448 | 8/1991 | Matsubara et al. | 84/622 |
| 5,054,359 | 10/1991 | Hikawa | 84/645 |
| 5,054,360 | 10/1991 | Lisle et al. | 84/645 |
| 5,056,402 | 10/1991 | Hikawa et al. | 84/645 |
| 5,220,117 | 6/1993 | Yamada et al. | 84/600 |
| 5,276,272 | 1/1994 | Masuda | 84/600 |
| 5,340,938 | 8/1994 | Sugita et al. | 84/622 X |
| 5,345,035 | 9/1994 | Yamada | 84/622 |
| 5,380,950 | 1/1995 | Kunimoto | 84/661 |

FOREIGN PATENT DOCUMENTS

| | | |
|---|---|---|
| 0376342 | 7/1990 | European Pat. Off. . |
| 0397149 | 11/1990 | European Pat. Off. . |
| 60-100199 | 6/1985 | Japan . |

OTHER PUBLICATIONS

Music & Sound Bible by Christopher Yavelow, pp. 762–763, 782–785 and 1332–1333.

Electronic Techniques, "Midi Network Structureing Method" by Li Chuan–Liang.

*Primary Examiner*—William M. Shoop, Jr.
*Assistant Examiner*—Jeffrey W. Donels
*Attorney, Agent, or Firm*—Graham & James

[57] ABSTRACT

An electronic musical instrument of the present invention provides a tone generator which includes an exciter generating an excitation signal and a sound producer having an input apparatus which produces a musical tone signal in response to the excitation signal. The-tone generator delays the musical tone signal and feeds the musical tone signal back to the input apparatus. Furthermore, the electronic musical instrument provides a memory which stores a plurality of sound production algorithms and an assignment designating apparatus which designates one of the plurality of sound production algorithms and assigns the designated sound production algorithm to the musical tone generator. Moreover, the tone generator further includes the operation apparatus which performs the assigned sound production algorithm on the musical tone signal. In addition, the electronic musical instrument provides the extractor which extracts the musical tone signal.

17 Claims, 9 Drawing Sheets

22

CH vs. NOTE NUMBER SET

| 0 | 1 | 2 | 3 | 4 | 5 | 6 | 7 |
|---|---|---|---|---|---|---|---|
| 4 | 2 | 5 | 2 | 2 | 3 | 5 | 4 |

FIG.7

22

TONE COLOR SET

CHANNEL=03

TONE = 02 : Grand Piano

FIG.8

```
/ins
    OUTw    tw32
    OUTr    tr32
    TL1w    tw32
    TL1r    tr32
    TL2w    tw33
    TL2r    tr33
    INw     iw1
    INr     ir1
    MR1w    iw2
    MR1r    ir2
    MR2w    iw3
    MR2r    ir3
/pro
    sio   INw     nop                          mr DE2

    dr    MR2w    smt t, TL1r, c1              mr DE1
                  smi r, MR2r, c1
    dr    MR1w    ami r, INr , c1
                  smt t, TL2r, c2
                  smi r, MR1r, c2        TL1w
                  ami r, INr , c2
                  mut   TL1r, r1
                                         TL2w mw DS1
                  mut   TL2r, r2         dw
                  nop                          mw DS2
                  nop                    dw              so0 OUTw
/end
```

INPUT | COMPUTING | TEMPORARY MEMORY | EXTERNAL MEMORY | OUTPUT

FIG.10 (PRIOR ART)

ELECTRONIC MUSICAL INSTRUMENT HAVING PRE-ASSIGNED MICROPROGRAM CONTROLLED SOUND PRODUCTION CHANNELS

This is a continuation of application Ser. No. 07/954,268 filed on Sep. 30, 1992, now abandoned.

BACKGROUND OF THE INVENTION

1. Field of the Invention

The present invention relates to electronic musical instruments, and more particularly, to electronic musical instruments capable of simulating the sound of conventional non-electronic musical instruments with high fidelity.

2. Prior Art

There is known a conventional electronic musical instrument comprising a PCM (Pulse Code Modulation) tone generating device (hereafter referred to as a tone generating device (1)) which reads pulse-code-modulated waveform data from a waveform memory based on a clock corresponding to MIDI (Musical Instrument Digital Interface) data generated in response to the operation of, for example, a keyboard by a performer. Such a conventional electronic musical instrument comprises a plurality of sound production channels, for example, 16 sound production channels, and each of these sound production channels independently produces sound by means of timesharing in response to the above MIDI data. For example, one sound production channel produces sound with the tone color of a piano at one timing and another sound production channel produces sound with the tone color of a violin at another timing.

Furthermore, physical model tone generating devices (hereafter referred to as tone generating devices (2)) are conventionally known which synthesize tones which effectively simulate the sound of a conventional non-electronic musical instrument by simulating the sound production algorithm in the target non-electronic instrument. Such a device is disclosed in U.S. Pat. No. 4,984,276.

One example of a linear portion of the above conventional tone generating device (2) is shown in the block diagram of FIG. 9. In this figure, an input terminal 1 is provided, to which an excitation signal waveform data made up of a large number of different high frequency components such as an impulse waveform is supplied. The excitation signal waveform data supplied via the input terminal 1 is supplied to the closed loop circuit via first input terminals of adders 2 and 3. The adder 3 adds the excitation signal waveform data and the output data read from an input memory 5 (MEMORY 2) which delays an input data for the desired time. The output data from the adder 3 is supplied to a multiplier 6 which multiplies it by a multiplicative coefficient C2. The output data from the multiplier 6 is supplied to a first input terminal of an adder 8. The output data from the adder 8 is stored in a temporary memory 9 (TL2) and supplied to a multiplier 11. The temporary memory 9 delays an input data, namely, the output data from the adder 8, for the desired time. The multiplier 11 multiplies an input data, namely, the output data from the adder 8, by a multiplicative coefficient r2. The data read from the temporary memory 9 is supplied to a multiplier 10. The multiplier 10 multiplies an input data, namely, the data read from the temporary memory 9, by a multiplicative coefficient 1-C2. The output data from the multiplier 10 is supplied to a second input terminal of the adder 8. The adder 8 adds the output data from the multiplier 6 and the output data from the multiplier 10. Each of elements 8 through 10 described above together form a low pass filter (LPF) 12. The output data from the multiplier 11 is stored in an input memory 4 (MEMORY 1) which delays it for the desired time.. The data read from the input memory 4 is supplied to a second input terminal of the adder 2.

The adder 2 adds the excitation signal waveform data and the data read from the input memory 4. The output data from the adder 2 is supplied to a multiplier 7 which multiplies it by a multiplicative coefficient C1. The output data from the multiplier 7 is supplied to a first input terminal of an adder 13. The output data from the adder 13 is stored in a temporary memory 14 (TL1) and supplied to a multiplier 16. The temporary memory 14 delays an input data, namely, the output data from the adder 13, for the desired time. The multiplier 16 multiplies an input data, namely, the output data from the adder 13, by a multiplicative coefficient r1. The data read from the temporary memory 14 is supplied to a multiplier 15. The multiplier 10 multiplies an input data, namely, the data read from the temporary memory 14 by a multiplicative coefficient 1-C1. The output data from the multiplier 15 is supplied to a second input terminal of the adder 13. The adder 13 adds the output data from the multiplier 7 and the output data from the multiplier 15. Each of elements 13 through 15 described above together form a low pass filter (LPF) 17. The output data from the multiplier 16 is stored in the input memory 5. The data read from the input memory 5 is supplied to a second input terminal of the adder 3.

Because the above conventional tone generating device (2) consists of a digital signal processor (DSP), it can synthesize various tones which effectively simulate the sound of conventional non-electronic musical instruments by simulating the various algorithms of sound production in the target non-electronic instruments by changing the microprogram (for example, see FIG. 10) used in the DSP. The above conventional tone generating device (2) as shown in FIG. 9 is an example of a tone generating device which synthesizes tone which effectively simulates the sound of a stringed instrument by simulating the sound production algorithm in the stringed instrument. An example of another type of tone generating device which synthesizes tones which effectively simulates the sound of another non-electronic musical instruments, for example, wind instruments, by simulating the sound production algorithm in the target non-electronic musical instruments, has been disclosed in Japanese Patent Application Laid-open Publication No. 2-280196.

In the above conventional electronic musical instrument comprising the above conventional tone generating device (1), a tone color number as well as performance information such as tone pitch and touch are supplied to the tone generating device (1) every key-on. Accordingly, if a performer designates tone color at each sound production, each of the sound production channels of the tone generating device (1) directly access the corresponding area of the waveform memory and read waveform data from it. Thus, as stated above, it is an easy matter for one sound production channel to produce sound with the tone color of a piano at one timing and to produce sound with the tone color of a violin at the next timing by means of timesharing.

In contrast, in the above conventional electronic musical instrument comprising the above conventional tone generating device (2), in the case of changing tone color at each key-on, there is a necessity either to supply a microprogram to the sound production channel at each key-on or to previously store a plurality of microprograms in each sound channel. Since the microprogram as shown in FIG. 10 is the microprogram corresponding to very a fundamental circuit construction as shown in FIG. 9, it does not take long to supply this microprogram to the sound production channel at each key-on. However, since the microprogram which accurately simulates the sound production algorithm in the target non-electronic musical instruments consists of a large number of data, when it is supplied to the sound production channel at each key-on, there is a drawback in that the key-on response is reduced due to the limitation on the data transmitting rate. In the case where previously storing a plurality of microprograms in each sound channel, there is a drawback in that the use efficiency of memory becomes lower and the system become expensive because great deal of memory is necessary.

SUMMARY OF THE INVENTION

In consideration of the above, it is an object of the present invention to provide an electronic musical instrument which is capable of efficiently using memory, and which is capable of producing the sounds of a plurality of tone colors every key-on without reducing key-on response.

To satisfy this object, the present invention provides an electronic musical instrument comprising tone generating means comprising an excitation means for generating an excitation signal and sound producing means having input means for producing a musical tone signal in response to the excitation signal, delaying the musical tone signal and feeding the musical tone signal back to the input means;

memory means for storing a plurality of sound production algorithms;

assignment designating means for designating one of the plurality of sound production algorithms and assigning the designated sound production algorithm to the musical tone generating means, the tone generating means further comprising operation means for performing the assigned sound production algorithm on the musical tone signal; and extracting means for extracting the musical tone signal.

According to such a structure, when a performer designates one of the plurality of sound production algorithms and assigns the designated sound production algorithm to the musical tone generating means using the assignment designating means, the operation means performs the assigned sound production algorithm on the musical tone signal.

Accordingly, the excitation means generates the excitation signal and the input means produces the musical tone signal in response to the excitation signal and the sound producing means delays the musical tone signal and feeds the musical tone signal back to the input means. Thus, the extracting means extracts the musical tone signal.

According to the present invention, there is the positive effect that the volume of the tone color buffer memory of each of the sound production channels can be minimized. Furthermore, there is the positive effect that a system having an efficient use of memory can be constructed. Moreover, there is the positive effect that the response to key-on is not less than in the conventional art. In addition, there is the positive effect that the generation of the musical forced tone that is caused by the limited number of sound production channels can be prevented because the order of priority of each of the tone colors in each of the sound production channels is prescribed.

BRIEF EXPLANATION OF THE DRAWINGS

FIG. 7 shows a display example of the display 22 of FIG. 2.

FIG. 8 shows another display example of the display 22 of FIG. 2.

FIG. 10 shows an example of the microprogram of the physical model tone generating device of FIG. 9.

DETAILED DESCRIPTION OF THE PREFERRED EMBODIMENTS

Figure 1:
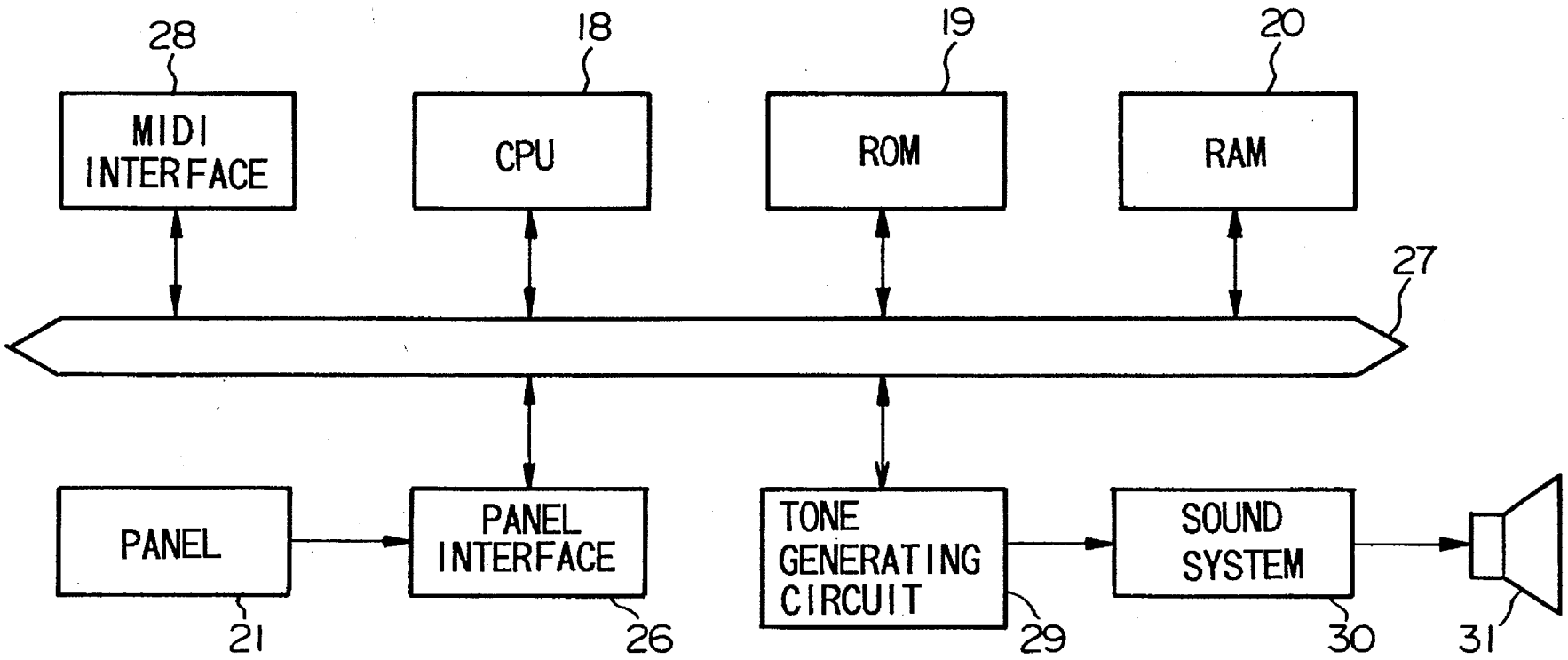
FIG. 1 shows a block diagram of the electrical structure of an electronic musical instrument based on the preferred embodiment of the present invention.

Hereinafter, an explanation of the preferred embodiment of the present invention is given by referring to the figures. FIG. 1 shows a block diagram of the structure of an electronic musical instrument in accordance with the preferred embodiment of the present invention. In this figure, a central processing unit (CPU) 18, which controls all apparatuses, a ROM 19, which has stored various control programs used in the CPU 18 and various microprograms loaded in the hereinafter described tone generating circuit 29 consisting of DSP and a RAM, and a RAM 20 are provided. Additionally, in the RAM 20, within which all types of registers, flags, and working buffers are maintained for use when the CPU 18 carries out any type of procedure, and MIDI data buffers are maintained for storing the MIDI data.

Figure 2:
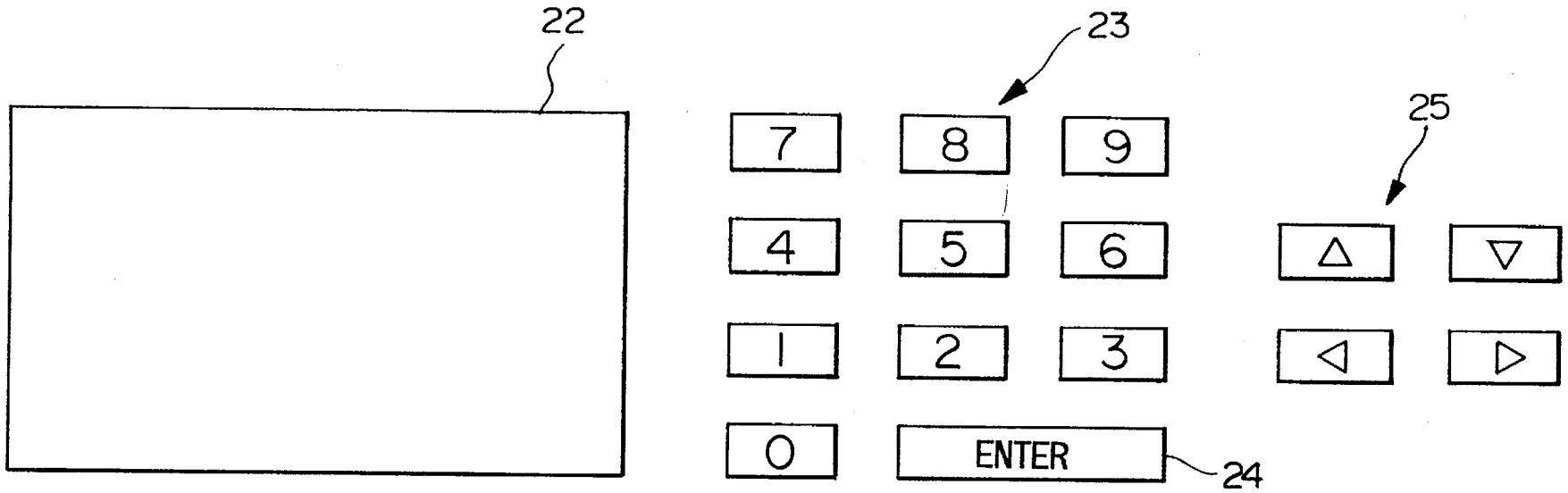
FIG. 2 shows an example of the external structure of the panel 21 of FIG. 1.

Furthermore, in FIG. 1, a panel 21 is provided, which consists of a display 22 such as a liquid crystal display, ten keys 23, an enter key 24 for designating, for example, the change of display or the like, cursor keys 25 for designating the movement of cursors on the display 22 and the like as shown in FIG. 2. The panel 21 supplies information in response to the operation of keys via a panel interface 26 and a system bus 27 to the CPU 18.

Moreover, in FIG. 1, a MIDI interface 28 is provided. The CPU 18 exchanges data such as MIDI data via the MIDI interface 28 and the system bus 27 with another electronic musical instrument or the like. A tone generating circuit 29 is provided, which synthesize tones which effectively simulate the sound of wind instruments such as the clarinet, rubbed stringed instruments such as the violin, plucked stringed instruments such as the guitar, and beat stringed instruments such as the piano by simulating the sound production algorithm in these. The tone generating circuit 29 consists of a plurality of DSPs and a plurality of RAMs in which temporarily store the various computing data of the plurality of DSPs, respectively. The set of DSP and RAM correspond to the hereafter described sound production channels. A sound system 30 is provided comprising amplifiers, etc., which amplify a plurality of musical tone signals supplied from the tone generating circuit 29. A speaker 31 is provided which transduces a plurality of the musical tone signals to the musical tone and delivers.

Next the flow of operation of the CPU 18 in the electronic musical instrument of the present invention will be described with reference to the flow charts of FIGS. 3 through 6.

Figure 3:
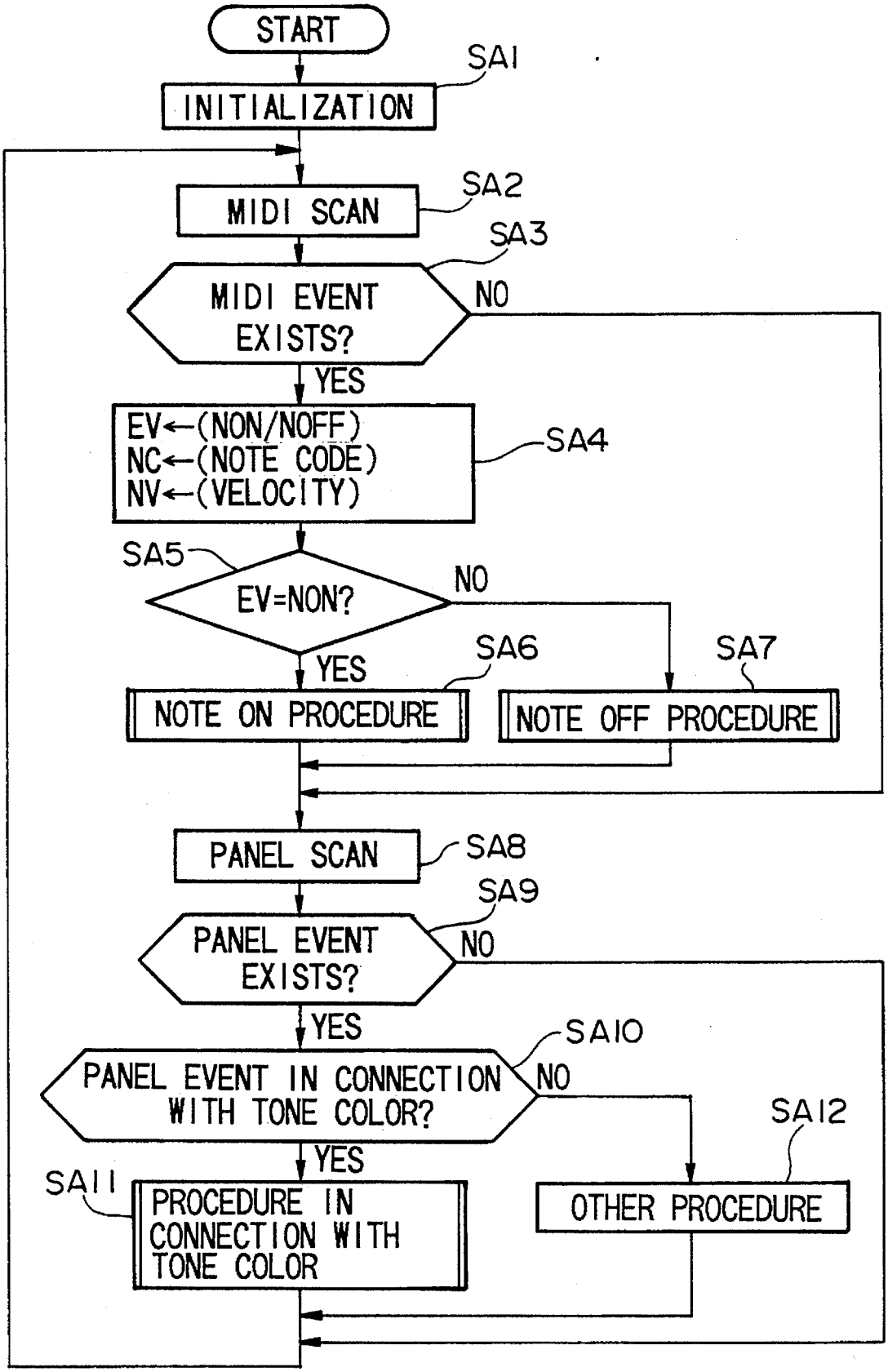
FIG. 3 is a flow chart showing the main procedure routine of the CPU 18 based on the preferred embodiment of the present invention.

When power is supplied to the device shown in FIG. 1, the CPU 18 begins to execute the main procedure routine shown in FIG. 3 starting with step SA1. In step SA1, the initialization of all apparatuses is carried out. This initialization consists of the setting of the initial tone color in the tone generating circuit 29, and the clearing of the registers of RAM 20. Next, MIDI interface 28 is scanned and the input state of MIDI data is detected in step SA2.

Next, in step SA3, judgment is made as to whether or not a MIDI event based on the input state of MIDI data detected in the MIDI scanning procedure of step SA2 exists. When the result of the judgment in SA3 is [YES], the routine proceeds to step SA4. In contrast, when the result of the judgment in step SA3 is [NO], that is, when the MIDI event is not detected, the routine proceeds to step SA8 described below.

In step SA4, the values corresponding to their respective detected states are stored in register EV, which temporarily stores a note on event NON or a note off event NOFF, register NC, which temporarily stores note code NC, and in register NV, which temporarily stores velocity.

Next, in step SA5, judgment is made as to whether or not the stored data in the register EV corresponds to a note on event NON. When the result of the judgment in SA5 is [YES], the routine proceeds to step SA6 and note on procedure (sound production procedure) is carried out in step SA6. In contrast, when the result of the judgment in step SA5 is [NO], that is, when the stored data in the register EV corresponds to the note off event NOFF, the routine proceeds to step SA7 and note off procedure (sound silencing procedure) is carried out in step SA7. The sound production procedure and the sound silencing procedure will be described below in detail. Next, when the sound production procedure or the sound silencing procedure have been carried out, the routine proceeds to step SA8.

In step SA8, the panel 21 is scanned to detect the operation state of the panel 21. Next, in step SA9, judgment is made as to whether or not there exists a panel event based on the state of panel 21 detected in the panel scanning procedure of step SA8. When the result of the judgment in SA9 is [YES], the routine proceeds to step SA10. In contrast, when the result of the judgment in step SA9 is [NO], in other words, when the panel event is not detected, the routine returns to step SA2.

In step SA10, judgment is made as to whether or not the panel event detected in step SA8 is in connection with tone color. When the result of the judgment in SA10 is [YES], the routine proceeds to step SA11 and the procedure in connection with the tone color is carried out in step SA11. In contrast, when the result of the judgment in SA10 is [NO], namely, when the panel event detected in step SA8 is not in connection with tone color, the routine proceeds to step SA12 and the procedures in step SA12 is carried out. The procedures relating to the tone color will be described below in detail. Next, when the procedures relating to the tone color and other procedures have been carried out, the routine returns to step SA2 and steps SA2 through SA12 are repeatedly carried out until the power is turned off.

Figure 4:
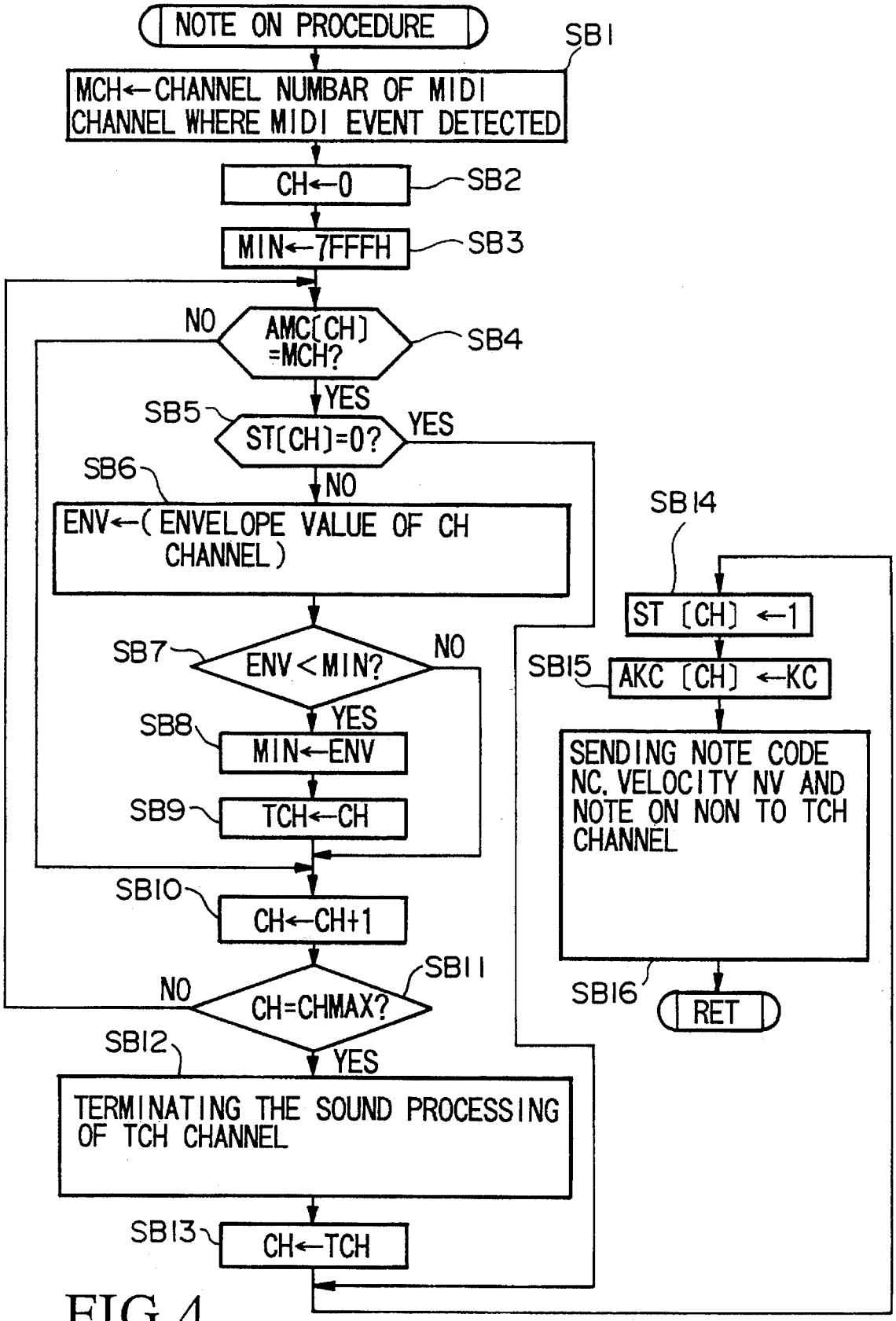
FIG. 4 is a flow chart showing the note on procedure routine of the CPU 18 based on the preferred embodiment of the present invention.

Next, the note on procedure of CPU 18 will be described with reference to the flow chart in FIG. 4. When the routine proceeds to step SA6 shown in FIG. 3, the CPU 18 begins to execute the note on procedure routine shown in FIG. 4 starting with step SB1. In step SB1, the number of the MIDI channel for which an event was detected is stored in the register MCH. Next, in step SB2, "0" is stored in a register CH, storing the number of the sound production channel so as to search the state of all of the sound production channels.

Next, in step SB3, "7FFF" ( maximum value in hexadecimals) is stored in the register MIN so as to truncate the sound production channel having the envelope value minimum when an open sound production channel does not exist.

In step SB4, a judgment is made as to whether or not the value in the register AMC[CH], in which what number MIDI channel has been assigned for the sound production channels set in register CH is stored, is identical to the value set in register MCH. When the result of the judgment in SB4 is [YES], the routine proceeds to step SB5. In contrast, when the result of the judgment in SB4 is [NO], namely, when the value stored in the register AMC[CH] is not equal to the value stored in the register MCH, the routine proceeds to step SB10 described below because the sound production channel corresponding to the value stored in the register AMC[CH] can not be assigned.

Next, in step SB5, judgment is made as to whether or not the value stored in the register ST[CH] (ST is a state signal), storing the state of the sound production channel corresponding to the number stored in the register CH, equals "0", namely, whether or not this sound production channel is in a channel standby state. When the result of the judgment in SB5 is [NO], the routine proceeds to step SB6. In contrast, when the result of the judgment in SB5 is [YES], in other words, when the value stored in the register ST[CH] equals "0", the routine proceeds to step SB14 described below because the open sound production channel corresponding to the value stored in the register ST[CH] exists.

In step SB6, the envelope value of the sound production channel in the tone generating circuit 29 corresponding to the number stored in the register CH is stored in the register ENV. Next, in step SB7, judgment is made as to whether or not the value stored in the register ENV is smaller than the value stored in the register MIN. When the result of the judgment in SB7 is [YES], the routine proceeds to step SB5. In contrast, when the result of the judgment in SB7 is [NO], that is, when the value stored in the register ENV is equal to or larger than the value stored in the register MIN, the routine proceeds to step SB10 described below.

In step SB5, the value stored in the register ENV is stored in the register MIN. Next, in step SB9, the value stored in the register CH is stored in the register TCH. In step SB10, "1" is added to the value stored in the register CH in order to search the next sound production channel. Next, in step SB11, judgment is made as to whether or not the new value stored in the register CH is equal to the total number of sound production channels CHMAX (for example, 32). When the result of the judgment in SB11 is [NO], the routine returns to step SB4 and the above-mentioned procedure is repeatedly carried out until the value stored in the register CH is equal to the total number of sound production channels. In contrast, when the result of the judgment in SB11 is [YES], that is, when the value stored in the register CH is equal to the total number sound production channels, the routine proceeds to step SB12.

In step SB12, the sound silencing procedure is carried out for silencing the sound of the sound production channel in the tone generating circuit 29 corresponding to the number stored in the register TCH. Next, in step SB13, the value stored in the register TCH is stored in the register CH. Next, in step SB14, "1" indicating the continuation state of sound producing based on note on, is stored in the register ST[CH].

In step SB15, the key code KC corresponding to the tone pitch to be produced is stored in the register AKC[CH], storing a key code KC in response to the sound production channel. Next, in step SB16, the note code NC, the velocity NV and the note on NON are supplied to the open sound production channel in the tone generating circuit 29 corresponding to the number stored in the register CH, and the routine returns to step SA8 of the main procedure routine shown in FIG. 4.

Figure 5:
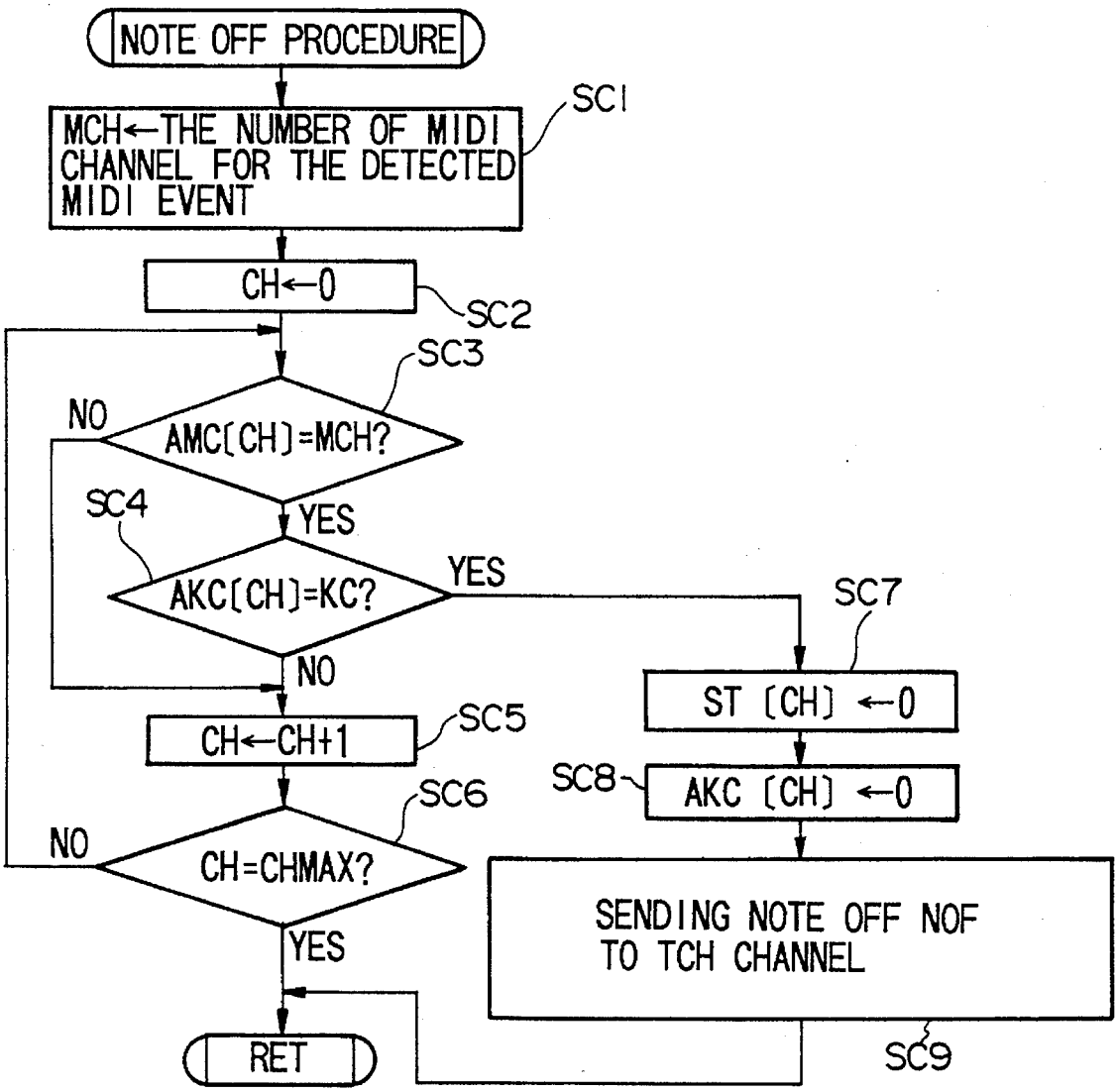
FIG. 5 is a flow chart showing the note off procedure routine of the CPU 18 based on the preferred embodiment of the present invention.

Next, the note off procedure of the CPU 18 will be described with reference to the flow chart of FIG. 5. When the routine proceeds to step SA7 shown in FIG. 3, the CPU 18 begins to execute the note off procedure routine shown in FIG. 5 starting with step SC1. In step SC1, the number of MIDI channels for which a MIDI event was detected is stored in the register MCH. Next, in step SC2, "0" is stored in register CH, storing the number of sound production channels in order to search the state of all of the sound production channel.

Next, in step SC3, judgment is made as to whether or not the value stored in the register AMC[CH] is equal to the value stored in the register MCH. When the result of the judgment in SC3 is [YES], the routine proceeds to step SC4. In contrast, when the result of the Judgment in SC3 is [NO], namely, when the value stored in the register AMC[CH] does not equal the value stored in the register MCH, the routine proceeds to step SC5 described below.

Next, in step SC4, judgment is made as to whether or not the value stored in the register AKC[CH] is equal to the key code KC. When the result of the judgment in SC4 is [NO], the routine proceeds to step SC5. In contrast, when the result of the judgment in SC4 is [YES], in other words, when the value stored in the register AKC[CH] is equal to the key code KC, the routine proceeds to step SC7 described below.

In step SC5, "1" is added to the value stored in the register CH in order to search the next sound production channel. Next, in step SC6, Judgment is made as to whether or not the new value stored in the register CH is equal to the total number sound production channels CHMAX (for example, 32). When the result of the judgment in SC6 is [NO], the routine returns to step SC3 and the above-mentioned procedure is repeatedly carried out until the value stored in the register CH is equal to the number of all of sound production channel. In contrast, when the result of the judgment in SC6 is [YES], that is, when the value stored in the register CH is equal to the total number of sound production channels, the routine returns to step SA8 of the main procedure routine shown in FIG. 4.

In step SC7, "0" indicating the channel standby state, is stored in the register ST[CH]. In step SC8, "0" is stored in the register AKC[CH]. Next, in step SC9, the note off NOFF is supplied to the sound production channel in the tone generating circuit 29 corresponding to the number stored in the register CH, and the routine returns to step SA8 of the main procedure routine shown in FIG. 4.

Figure 6:
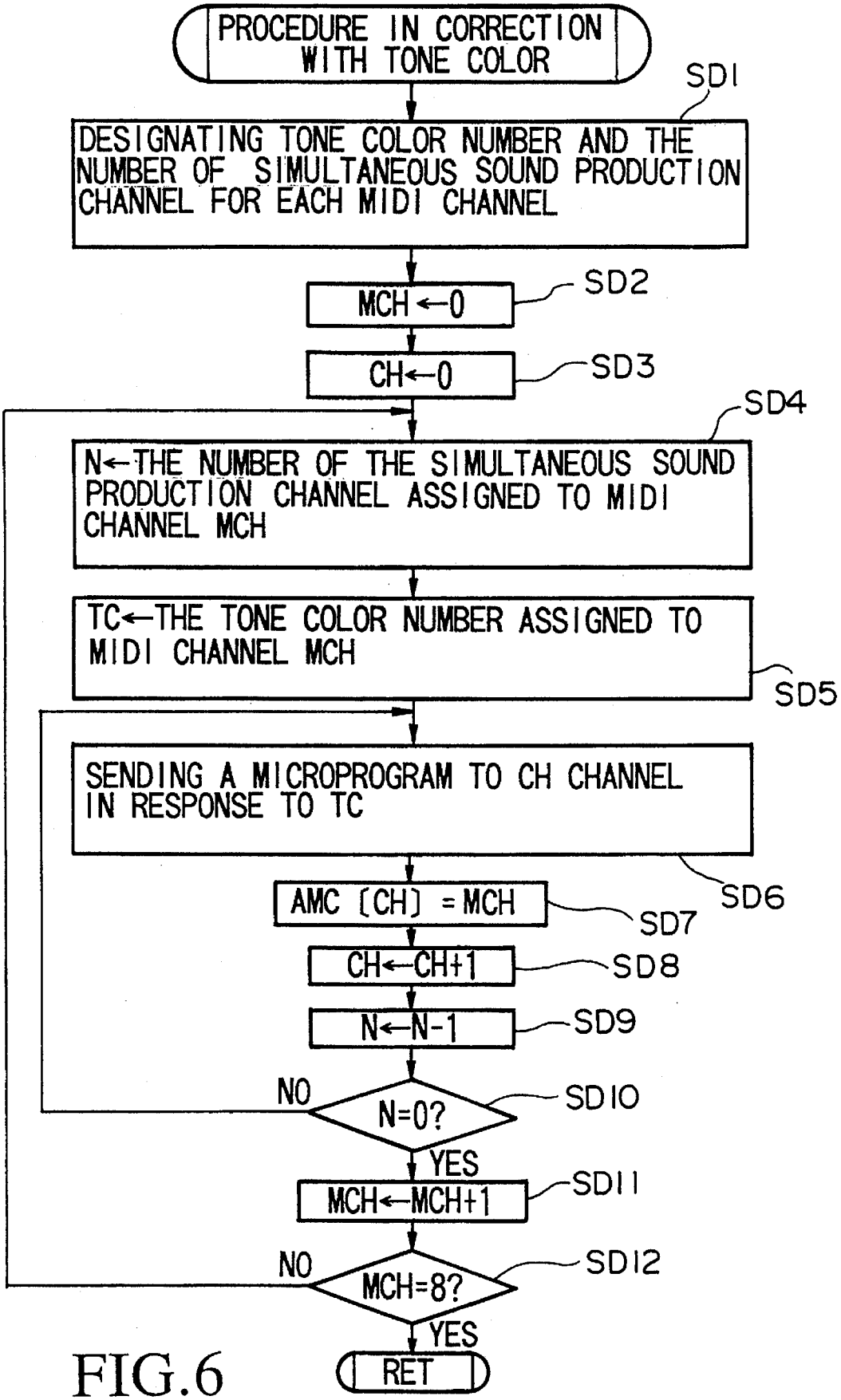
FIG. 6 is a flow chart showing the procedure routine in connection with the note color of the CPU 18 based on the preferred embodiment of the present invention.
Figure 9:
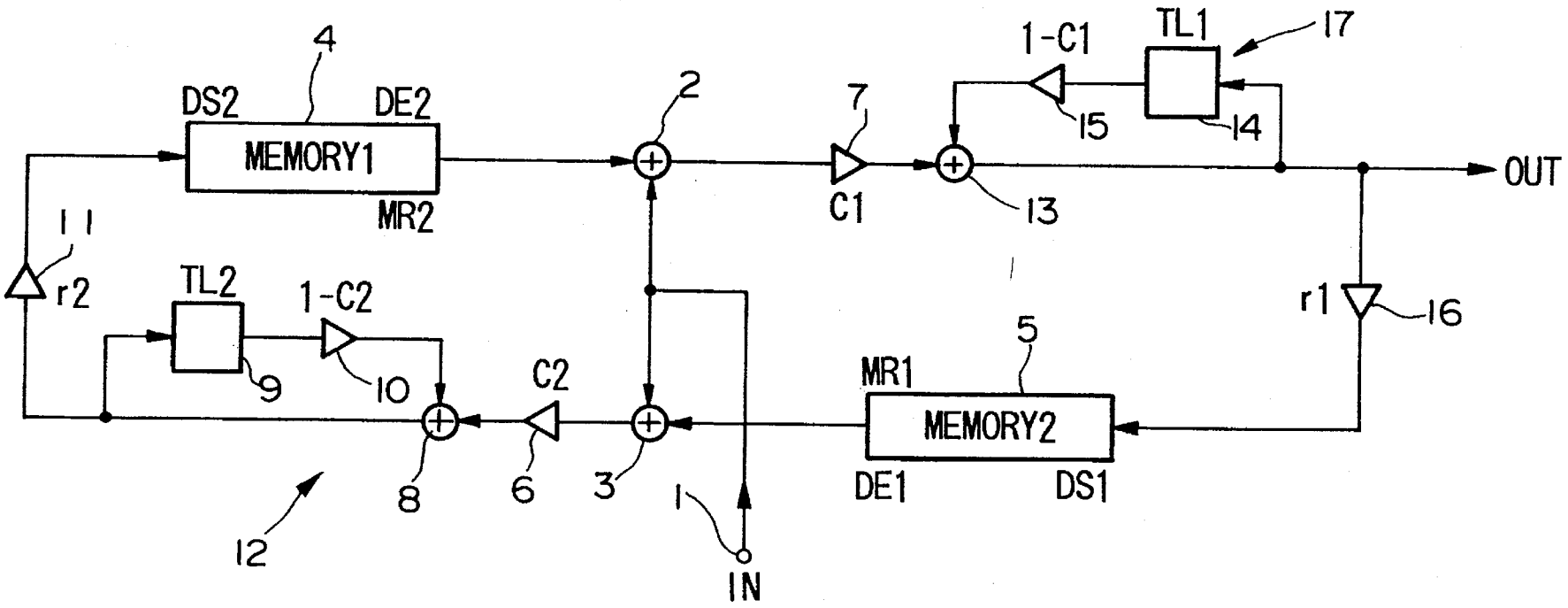
FIG. 9 (PRIOR ART)
FIG. 9 shows a block diagram of a structural example of the linear portion of the physical model tone generating device of the prior art.

Next, the procedure in connection with the tone color of the CPU 18 will be described with reference to the flow chart in FIG. 6. When the routine proceeds to step SA11 shown in FIG. 3, the CPU 18 begins to execute the procedure in connection with the tone color routine shown in FIG. 6 starting with step SD1. In step SD1, the number of sound production channel and the tone color number for each MIDI channel is stored in the registers based on the operation of the panel 21 by operator. Namely, when the operator selects the number of the sound production channel and the tone color number for each MIDI channel using the ten keys 23, the enter key 24 and the cursor key 25 of the panel 21 shown in FIG. 2, the CPU 18 stores the number of sound production channel and the tone color number for each MIDI channel in the corresponding registers of the RAM 20. The CPU18 displays the number of sound production channel and the tone color number selected for each MIDI channel on the display 22, as shown, for example, in FIGS. 7 and 8. In the example shown in FIG. 7, 4 sound production channels are assigned to MIDI channel 0, 2 sound production channels are assigned to MIDI channel 1, . . . and 4 sound production channels are assigned to MIDI channel 7. In the example shown in FIG. 8, tone color corresponding to the tone color number 02, that is, the tone color of a grand piano is assigned to MIDI channel 3.

In step SD2, "0" is stored in the register MCH in order to decide the state of the sound production channel of each MIDI channel for which the number of sound production channels and the tone color number are selected by the operator. Next, in step SD3, "0" is stored in register CH in order to decide the state of all of the sound production channels selected for the MIDI channels.

Next, in step SD4, the number of sound production channels assigned to the MIDI channel corresponding to the number stored in the register MCH, for example, 4 in case of MIDI channel 0, is stored in the register N. In step SD5, the tone color number of the sound production channel assigned to the MIDI channel corresponding to the number stored in the register MCH, for example, 02 in case of MIDI channel 3, is stored in the register TC.

In step SD6, the microprogram corresponding to the tone color number stored in the register TC, for example, the microprogram of a violin, is supplied to the sound production channel in the tone generating circuit 29 corresponding to the number stored in the register CH. Next, in step SD7, the value stored in the register MCH is stored in the register AMC[CH], in which is recorded what MIDI channel number is assigned for the sound production channel stored in the register CH.

In step SD8, "1" is added to the value stored in the register CH in order to decide the state of the next sound production channel. Next, in step SD9, "1" is subtracted from the value stored in the register N so as to decide the state of the next sound production channel assigned to the same MIDI channel. In step SD10, judgment is made as to whether or not the new value stored in the register N is equal to "0". When the result of the judgment in SD10 is [NO], the routine returns to step SD6 and the above,mentioned procedure is repeatedly carried out for all of the sound production channels assigned to the same MIDI channel. In contrast, when the result of the judgment in SD10 is [YES], that is, when the value stored in the register N is equal to "0", the routine proceeds to step SD11.

In step SD11, "1" is added to the value stored in the register MCH in order to decide the state of the next MIDI channel. Next, in step SD12, Judgment is made as to whether or not the new value stored in the register MCH is equal to "8". When the result of the judgment in SD12 is [NO], the routine returns to step SD4 and the above-mentioned procedure is repeatedly carried out for all MIDI channel. In contrast, when the result of the judgment in SD12 is [YES], that is, when the value stored in the register MCH is equal to "8", the routine returns to step SA2 of the main procedure routine shown in FIG. 4.

With the electronic musical instrument of the embodiment of the present invention as thus described above, a plurality of tone colors are preassigned to each of the sound production channels limited in number, a plurality of microprograms corresponding to a plurality of tone colors are presupplied to each of the sound production channels assigned and sounds are produced in the assigned sound production channel in response to the MIDI data. Accordingly, it is possible to minimize the volume of memory and construct a system having an efficient utilization of memory. Furthermore, response to a key-on can be carried out more quickly than in the conventional art. Moreover, generation of a forced musical tone which is caused by the limited number of the sound production channels can be prevented because the order of priority of each of the tone colors in each of the sound production channels is prescribed.

What is claimed is:

1. An electronic musical instrument comprising:

plural channel tone generating means generating musical tones by executing given programs sequentially in which at least some of the channels comprise an excitation means for generating an excitation signal and sound producing means having input means for producing a musical tone signal in response to said excitation signal, delaying said musical tone signal and feeding said musical tone signal back to said input means;

memory means for storing a plurality of said programs for realizing sound production algorithms, the algorithms for use in the tone generating means;

designating means for designating which of said plurality of sound production algorithms is to be used by a respective one of said plural channels; and assignment means for retrieving a designated sound production algorithm from the memory means and transferring said designated sound production algorithm to said respective channel for storage in the channel.

2. An electronic musical instrument according to claim 1 wherein each of said plurality of sound production algorithms imparts a characteristic of a musical sound to a musical tone signal produced in each of the channels.

3. An electronic musical instrument according to claim 1 wherein each of said channels includes a digital signal processor.

4. An electronic musical instrument according to claim 1 wherein each channel includes:

a data processing apparatus; and an associated memory storage area wherein the algorithm program assigned to each respective channel is stored in the associated memory storage area for that channel.

5. An electronic musical instrument according to claim 1 wherein the number of sound production algorithms stored in the memory means is greater than the number of sound production channels.

6. A musical tone processing apparatus comprising:

a plurality of tone generating means each including a plurality of sound production channels for generating a musical tone generated by executing a sound production program sequentially;

tone color designating means for designating tone colors of musical tones;

sound production channel designating means for designating at least one sound production channel to produce each tone color designated by the tone color designating means; and sound production program supplying means for supplying sound production programs to the sound production channels designated by the sound production channel designating means wherein each program supplied corresponds the tone color to be produced by the sound production channel designated.

7. A musical tone processing apparatus according to claim 6 wherein the sound production programs comprise machine readable computer code.

8. A musical tone processing apparatus according to claim 6 wherein the tone generating means comprises a digital signal processor.

9. A musical tone processing apparatus according to claim 6 wherein:

the tone generating means further comprises a plurality of MIDI channels wherein each MIDI channel comprises at least one of the sound production channels.

10. A musical tone processing apparatus according to claim 9 wherein:

the sound production channel designating means designates at least one MIDI channel to produce a tone color designated by the tone color designating means wherein at least one sound production channels in each designated MIDI channel is for producing the designated tone.

11. A musical tone processing apparatus according to claim 10 wherein:

the sound production program supplying means is for supplying a respective sound production program corresponding to the designated tone color to each sound production channel in each MIDI channel.

12. A musical tone processing apparatus according to claim 6 further comprising:

sound production designating means for designating the generation of a musical tone by at least one sound production channel wherein the musical tone generated has the tone color designated for each respective sound production channel; and controlling means for controlling the respective sound production channel for each sound production channel for which generation of a musical tone is designated by the sound production designating means.

13. An electronic musical instrument according to claim 6 wherein each sound production channel includes:

a data processing apparatus; and an associated memory storage area wherein the program assigned to each respective channel is stored in the associated memory storage area for that channel.

14. An electronic musical instrument according to claim 13 further comprising a random access memory area including plural memory storage areas including the memory storage areas associated with each sound production channel.

15. A method for processing a musical tone comprising:

storing a plurality of sound production algorithms in a memory for synthesizing a designated musical tone by being executed sequentially;

designating a sound production algorithm to be provided to a sound production channel;

retrieving the sound production algorithm designated in the designating step from the memory;

providing the designated sound production algorithm designated in the designating a sound production algorithm step to the respective sound production channel wherein the algorithm is stored in a memory assigned to the sound production channel.

16. A method for processing a musical tone according to claim 15 further comprising before:

designating a tone color before the designating a sound production algorithm step; and designating at least one sound production channel to produce the tone color designated in the designating a tone color step before the assigning step.

17. A method for processing a musical tone according to claim 15 wherein:

the method is performed in an apparatus comprising a plurality of sound production channels; and the number of sound production algorithms stored in the memory in the storing step is greater than the number of sound production channels.

* * * * *